US011834819B2

(12) United States Patent
Tiefenthaler

(10) Patent No.: US 11,834,819 B2
(45) Date of Patent: Dec. 5, 2023

(54) ODORLESS TOILET SYSTEM

(71) Applicant: Scott Tiefenthaler, Fairfield, CT (US)

(72) Inventor: Scott Tiefenthaler, Fairfield, CT (US)

( * ) Notice: Subject to any disclaimer, the term of this patent is extended or adjusted under 35 U.S.C. 154(b) by 0 days.

(21) Appl. No.: 17/749,749

(22) Filed: May 20, 2022

(65) Prior Publication Data

US 2023/0060739 A1 Mar. 2, 2023

Related U.S. Application Data

(60) Provisional application No. 63/238,809, filed on Aug. 31, 2021.

(51) Int. Cl.
*E03D 9/052* (2006.01)

(52) U.S. Cl.
CPC ..... *E03D 9/052* (2013.01)

(58) Field of Classification Search
CPC ..... E03D 9/05; E03D 9/052
See application file for complete search history.

(56) References Cited

U.S. PATENT DOCUMENTS

| | | | | |
|---|---|---|---|---|
| 3,849,808 | A | 11/1974 | Goodwin et al. | |
| 5,199,111 | A | 4/1993 | Antepenko | |
| 5,355,536 | A | 10/1994 | Prisco | |
| 5,452,481 | A | 9/1995 | Meyer | |
| 5,724,682 | A | 3/1998 | Johnson | |
| 6,052,837 | A * | 4/2000 | Norton | A47K 13/307 4/213 |
| 6,795,980 | B1 | 9/2004 | Ries | |
| 7,065,801 | B1 | 6/2006 | Klepfer | |
| 7,120,942 | B2 | 10/2006 | Kline et al. | |
| 7,356,872 | B2 | 4/2008 | Jones | |
| 7,380,292 | B1 | 6/2008 | Harris | |
| 7,921,477 | B2 * | 4/2011 | Casale | A47K 13/307 4/216 |
| 8,434,170 | B1 | 5/2013 | Ramos | |
| 9,683,358 | B1 * | 6/2017 | Coury | A47K 13/307 |
| 9,756,996 | B1 * | 9/2017 | Ruiz | E03D 9/05 |
| 10,188,246 | B1 | 1/2019 | Ciotic | |
| 2007/0024025 | A1 | 10/2007 | Foerster | |
| 2007/0029481 | A1 | 12/2007 | Lee | |
| 2009/0293182 | A1 | 12/2009 | Kret | |
| 2012/0027167 | A1 | 9/2012 | Ineson | |
| 2012/0227170 | A1 | 9/2012 | Ineson | |
| 2013/0205484 | A1 | 8/2013 | Taciuc | |
| 2013/0269091 | A1 | 10/2013 | Sollami | |

(Continued)

FOREIGN PATENT DOCUMENTS

| | | | |
|---|---|---|---|
| EP | 1839547 | A1 | 10/2007 |
| GB | 2136030 | A | 9/1984 |

OTHER PUBLICATIONS

The Odorless, The Odorless Features, Dec. 31, 2020.

(Continued)

*Primary Examiner* — Christine J Skubinna
(74) *Attorney, Agent, or Firm* — ZIEGLER IP LAW GROUP, LLC

(57) ABSTRACT

A system for removing odors from a toilet includes a ventilated seat assembly, a powered exhaust system, and one or more vent couplers coupled between the ventilated seat assembly and the powered exhaust system, wherein the powered exhaust system is configured to draw air from the ventilated seat assembly through the one or more vent couplers.

13 Claims, 12 Drawing Sheets

(56) References Cited

U.S. PATENT DOCUMENTS

| | | | | |
|---|---|---|---|---|
| 2014/0137317 | A1* | 5/2014 | Sollami | E03D 9/05 4/213 |
| 2015/0292189 | A1 | 10/2015 | Chavez | |
| 2017/0073952 | A1* | 3/2017 | Slover | A47K 13/24 |
| 2018/0163384 | A1* | 6/2018 | Tyson | E03D 9/05 |
| 2021/0140161 | A1 | 5/2021 | Salazar | |

OTHER PUBLICATIONS

Miracle Seat, Product Description and Details, Dec. 31, 2021.
K-5588 Purefresh Elongated Toilet Seat Kohler, https://www.us.kohler.com/us/purefresh-elongated-toilet-seat/productDeatail/toilet-seats/1065579.htm; retrieved May 25, 2022.
Bio Bidet Bliss BB2000 Elongated White Smart Toilet Seat, Premier Class, Unlimited Warm Water, Vortex Wash, Bidet Seat, https://www.amazon.com/BioBidet-Elongated-Unlimited-Hydroflush-Nightlight/dp/B00GRM11R6/ref=sr_1_5?crid=17T2MF7M41SX2&keywords=bio+bidet&qid=1645108733&sprefix=bio%2Caps%2C66&sr=8-5; retrieved May 25, 2022.

* cited by examiner

ODORLESS TOILET SYSTEM

FIELD

The present disclosure relates to a system for removing bathroom odors from a toilet.

BACKGROUND

Bathroom odors are generally considered unpleasant and unwelcome, and are usually addressed by a whole room exhaust fan that allows odors to diffuse into the bathroom space and then exhausts some of those odors as well as a substantial amount of cooled or heated room air to the outside.

SUMMARY

It would be advantageous to provide a system that addresses bathroom odors in a more efficient and efficacious manner while maintaining indoor air quality with an enhanced level of energy efficiency.

In at least one aspect, the disclosed embodiments are directed to a system for removing odors from a toilet including a ventilated seat assembly, a powered exhaust system, and one or more vent couplers coupled between the ventilated seat assembly and the powered exhaust system, wherein the powered exhaust system is configured to draw air from the ventilated seat assembly through the one or more vent couplers.

The ventilated seat assembly may include a seat having a top side, a bottom side, a front portion and a rear portion, a vent cavity within the seat and having an inlet opening on the bottom side of the seat and at least one outlet to the one or more vent couplers, a vent cover plate covering the opening of the vent cavity, and a bowl ridge seal extending from a bottom side of the seat assembly.

The vent cover plate may include openings through which air may be drawn into the vent cavity.

The bowl ridge seal may extend from a bottom surface of the vent cover plate along a perimeter of the vent cover plate, and may flexibly contact a top or side edge of a toilet bowl on which the ventilated seat assembly is installed to provide at least a partial seal for guiding air into the vent cover plate.

The bowl ridge seal may extend from the bottom side of the seat along a perimeter of the seat, and may flexibly contact a top or side edge of a toilet bowl on which the ventilated seat assembly is installed to provide at least a partial seal for guiding air into the vent cover plate.

At least one of the one or more vent couplers may include a cap.

At least one of the one or more vent couplers may include a vent tail extending laterally from the rear portion of the seat, and a vent pipe coupled to the vent tail and to the powered exhaust system, where the laterally extending vent tail is configured to rotate with the seat as the seat rotates open and closed, while the vent pipe remains stationary.

The powered exhaust system may include an electronic control unit, and a fan for drawing air from the vent couplers.

The electronic control unit may include a motion sensor, and a microcontroller having a memory with computer readable program code, where the microcontroller under control of the computer readable program code is configured to implement a first operational mode, where, upon detecting a first motion by the motion sensor, power is applied to the fan, and upon detecting a second motion by the motion sensor, power is disconnected from the fan.

The electronic control unit may further include a presence sensor, and the microcontroller under control of the computer readable program code configured to implement a second operational mode where, upon detecting a third motion by the motion sensor, power is applied to the fan, and upon no longer detecting a presence by the presence sensor, power is disconnected to the fan after a programmable delay; and The microcontroller under control of the computer readable program code is configured to implement a third operational mode where, upon detecting a presence by the presence sensor, power is applied to the fan, and upon no longer detecting a presence by the presence sensor, power is disconnected from the fan after a programmable delay.

The system may include a mode switch, where the microcontroller determines the operational modes of the system based on positions of the mode switch.

The system may include a manual fan speed control; where the microcontroller adjusts power to the fan based on positions of the manual fan speed control.

The powered exhaust system may include a connection to a mains power supply for powering the electronic control unit.

The powered exhaust system may include a battery for powering the electronic control unit.

The system may include a filter coupled to the fan for filtering odors from the air flowing from the vent couplers.

DETAILED DESCRIPTION

Figure 1B:
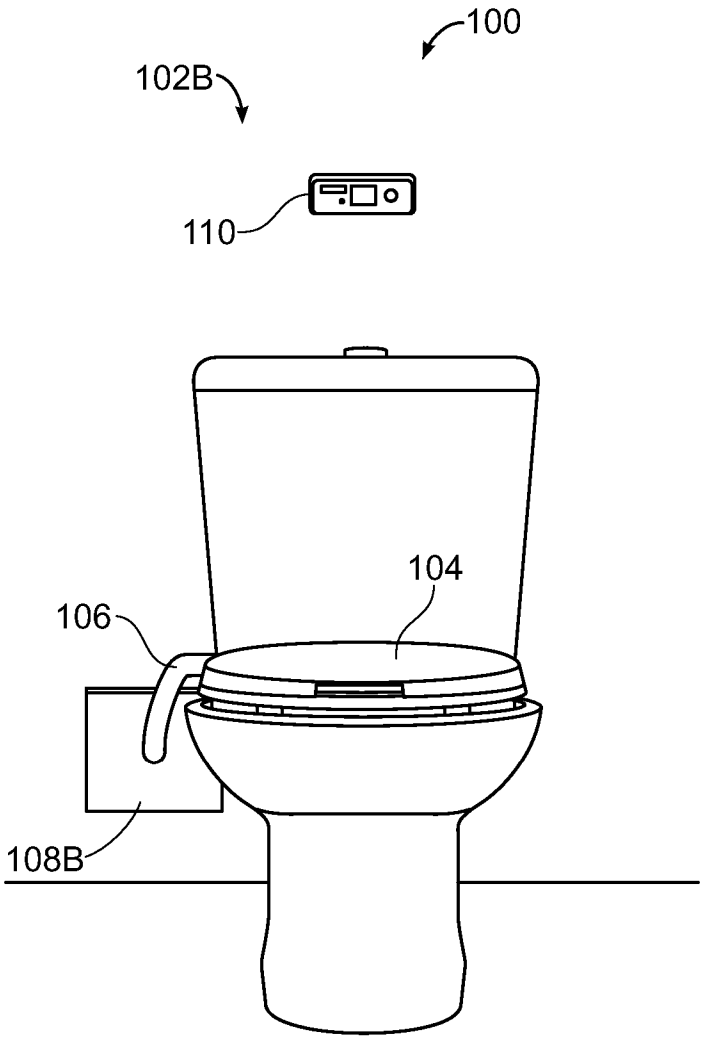
FIG. 1B illustrates an exemplary built-in embodiment.
Figure 1A:
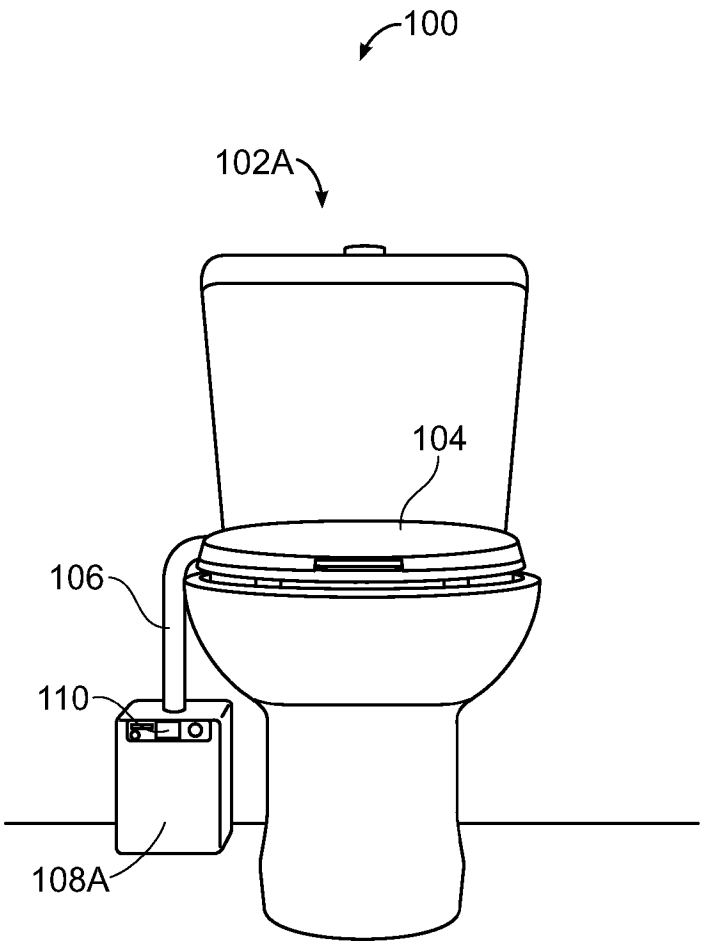
FIG. 1A illustrates an exemplary retrofit embodiment.

The disclosed embodiments are generally directed to an effective and inexpensive solution to the problem of bathroom odors. The disclosed embodiments are directed to an odor removing system that improves indoor air quality by capturing toilet odors at the source and eliminating them without the inefficiencies of the whole-room exhaust fan. FIG. 1A illustrates that the odor removing system 100 of the disclosed embodiments may include a retrofit aspect 102A utilized for an existing toilet fixture to neutralize odors, and FIG. 1B illustrates that the disclosed embodiments may include a built-in aspect 102B utilized for new or renovated toilet facilities. Both aspects of the odor removing system 100 may generally include a ventilated seat assembly 104, one or more vent couplers 106, coupled to the ventilated seat assembly 104 and configured to draw air from the ventilated seat assembly 104, and a powered exhaust system 108A, 108B for drawing air from the vent couplers. Both aspects of the odor removing system 100 may also include an electronic control unit 110 coupled to the powered exhaust system 108A, 108B.

Figure 2A:
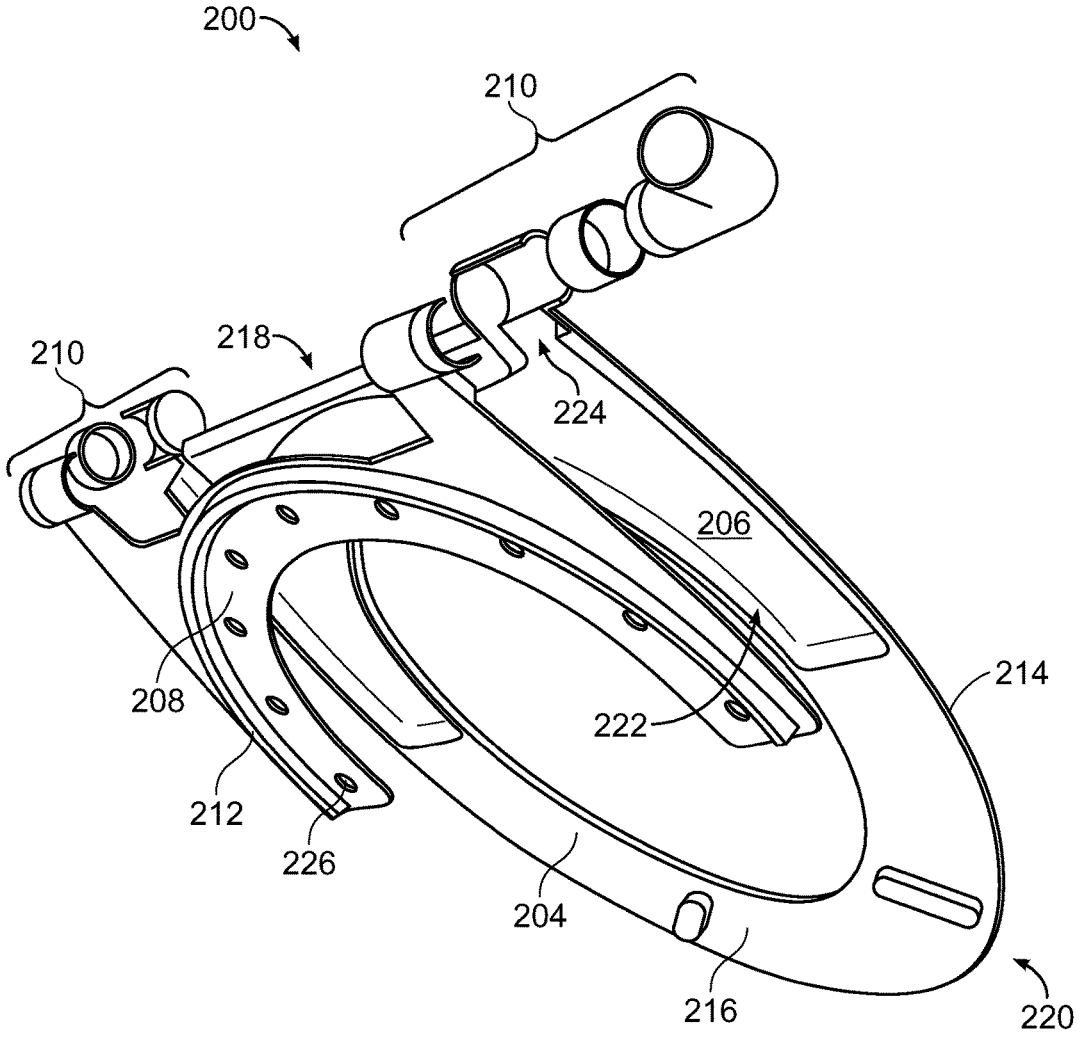
FIG. 2A illustrates an exploded diagram of an exemplary ventilated seat assembly according to the disclosed embodiments.
Figure 2B:
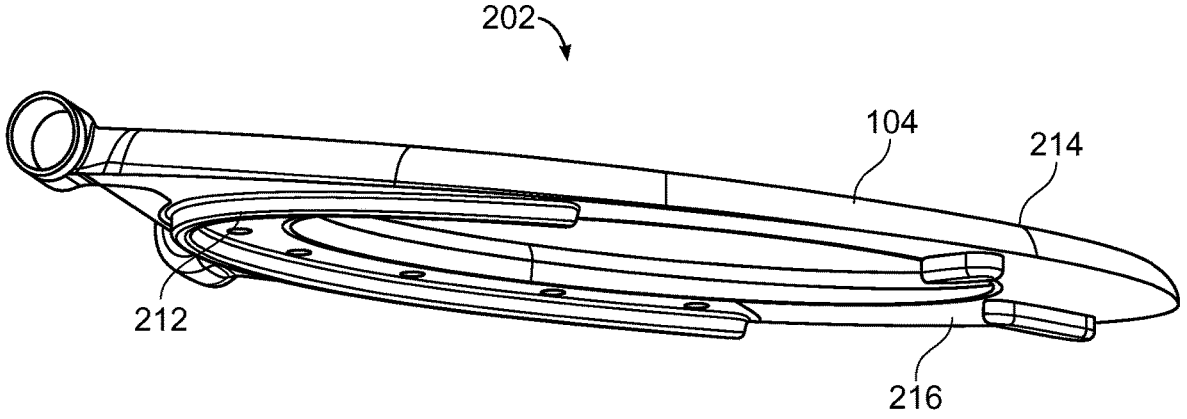
FIG. 2B illustrated an exemplary assembled diagram of the ventilated seat assembly.

FIG. 2A illustrates an exemplary exploded diagram 200 of the ventilated seat assembly 104 and FIG. 2B illustrates an exemplary assembled diagram 202 of the ventilated seat assembly 104. The ventilated seat assembly 104 may generally include a conventional lid, not shown, a seat 204, a vent cavity 206 within the seat 204, a vent cover plate 208, portions 210 of the vent couplers 106, and a bowl ridge seal 212 extending from a bottom side of the ventilated seat assembly 104.

The seat 204 may have a top side 214, a bottom side 216, a front portion 218, and a rear portion 220. The seat 204 may have conventional exterior dimensions conforming to standard round, elongated, or u-shaped types of toilet seats or any other suitable dimensions or shapes. The seat 204 may be constructed of solid wood, medium density fiberboard, bamboo, plastic, resin, or any other suitable material. The seat 204 may be attached to a toilet using hinges (item 402, FIG. 4) which may be slow close hinges.

The vent cavity 206 may encompass a hollow space within the seat 204 and may include an inlet opening 222 providing a conduit for incoming air flow, for example, from a toilet bowl, through the vent cover plate 208, and an outlet 224 into the one or more portions 210 of the vent couplers 106. While illustrated as occupying a portion of the seat 204, it should be understood that the vent cavity 206 may extend along any suitable portion within the seat 204 and may extend throughout the interior of the seat 204.

Figure 3A:
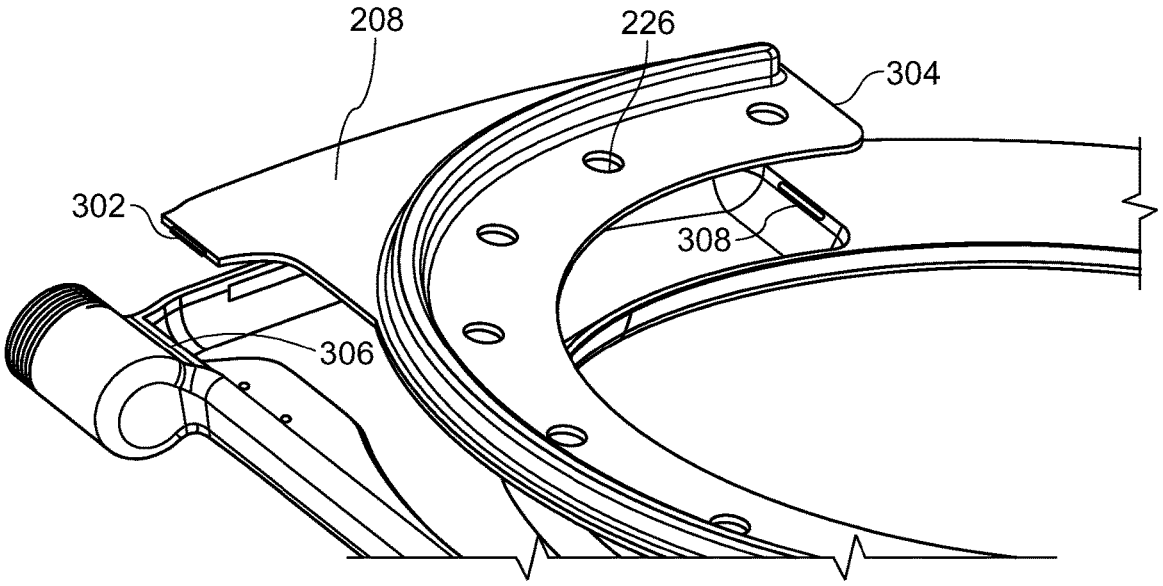
FIG. 3A illustrates at least one embodiment where a vent cover plate is attached to a seat and FIG. 3B shows another view of the vent cover plate and the seat.

The vent cover plate 208 may provide a bottom cover for the vent cavity 206 and may be removably attached to the bottom side 216 of the seat 204, using fasteners, an adhesive or any suitable fastening mechanism. FIG. 3A illustrates at least one embodiment where the vent cover plate 208 may be attached to the seat 204 using a tab and slot arrangement, where the vent cover plate 208 includes tabs 302, 304 that may fit into slots 306, 308, respectively, of the seat 204.

Figure 3B:
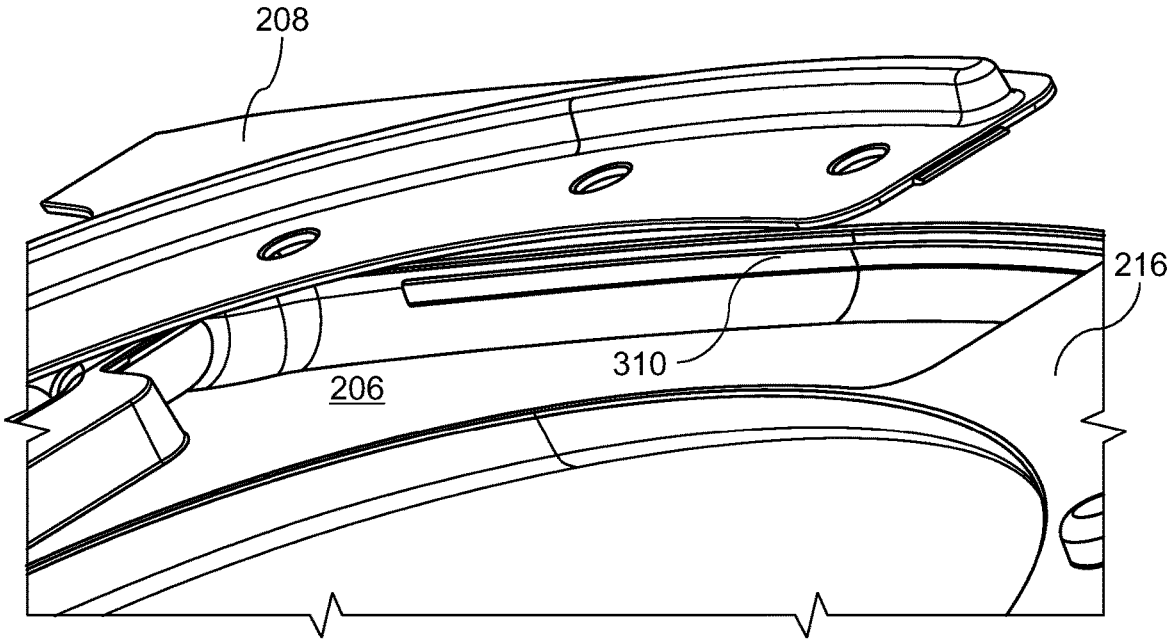

FIG. 3B shows another view of the vent cover plate 208 and the bottom side 216 of the seat 204. A shoulder 310 is provided on an interior wall of the vent cavity 206 to support the vent cover plate 208. In some embodiments, the shoulder 310 may prevent the vent cover plate from being pushed into the vent cavity 206, in particular when weight is applied to the seat and the bowl ridge seal 212 contacts a top or side edge of a toilet bowl, as explained below. It should be understood that corresponding tabs and slots may be interchanged and provided in any combination between the seat 204 and the vent cover plate 208.

The ability to remove the vent cover plate 208 from the vent cavity 206 and from the seat 204 is advantageous in that the vent cover plate 208, vent cavity 206, and seat 202 may be cleaned and maintained in sanitary condition, however, in some embodiments, the vent cover plate 208 may be molded to, or otherwise integral with the seat 202.

The vent cover plate 208 may be constructed of wood, metal, medium density fiberboard, bamboo, plastic, resin, or any other material suitable. As shown in FIGS. 2A and 3, the vent cover plate 208 may include any number of openings 226, 310 of any shape or size through which air flow may be drawn into the vent cavity 206.

Returning to FIGS. 2A and 2B, the bowl ridge seal 212 may extend from a bottom surface of the vent cover plate 208 along a perimeter of the vent cover plate 208, and may be located adjacent to, or may slidingly contact a top or side edge of a toilet bowl on which the ventilated seat assembly 104 is installed, in order to provide a at least a partial seal between the vent cover plate 208 and the toilet bowl for guiding air flow through the toilet bowl into the vent cover plate 208 and into the vent cavity 206, in particular when weight is applied to the seat 202.

In other embodiments, the bowl ridge seal 212 may extend from a bottom surface of the seat 204 along a perimeter of the seat 202, and may be located adjacent to, or may flexibly contact a top or side edge of a toilet bowl on which the seat 202 is installed to provide the at least a partial seal for guiding air flow into the vent cover plate 208, in particular when weight is applied to the seat 202.

Figure 4:
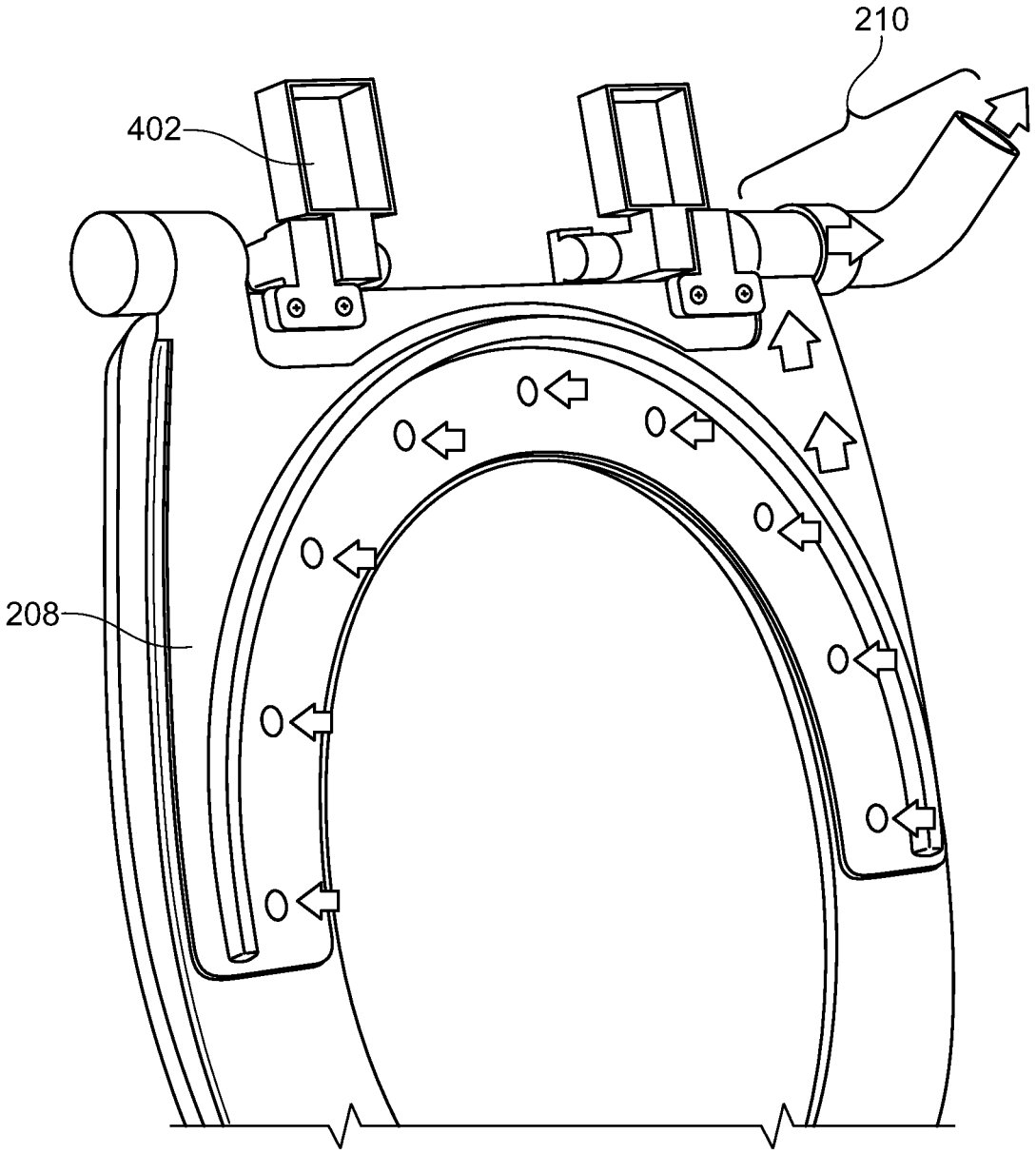
FIG. 4 illustrates an air flow produced by the disclosed embodiments.

As shown in FIG. 4, the ventilated seat assembly 104 may be attached to a toilet using hinges 402. The vent cover plate 208, the vent cavity 206 (not shown), and the vent coupler portion 210 may provide an air flow shown by the arrows from the bottom side 216 of the seat 204 to the powered exhaust system 108A, 108B.

Figure 5A:
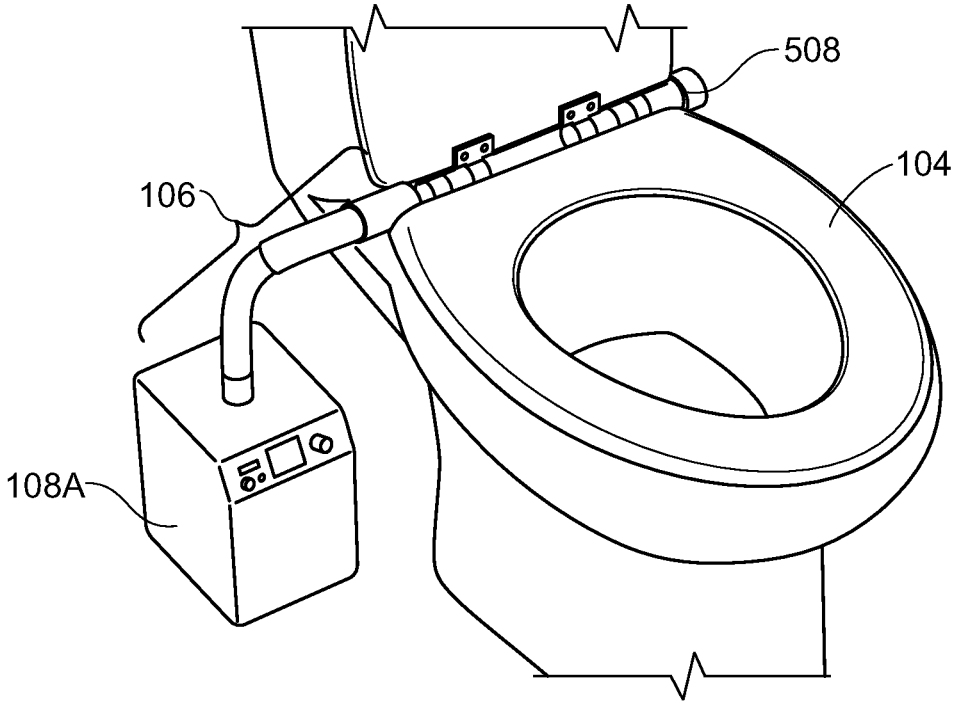
FIGS. 5A-5C show examples of a vent coupler coupled between the ventilated seat assembly and retrofit and built in versions of the powered exhaust system.
Figure 5B:
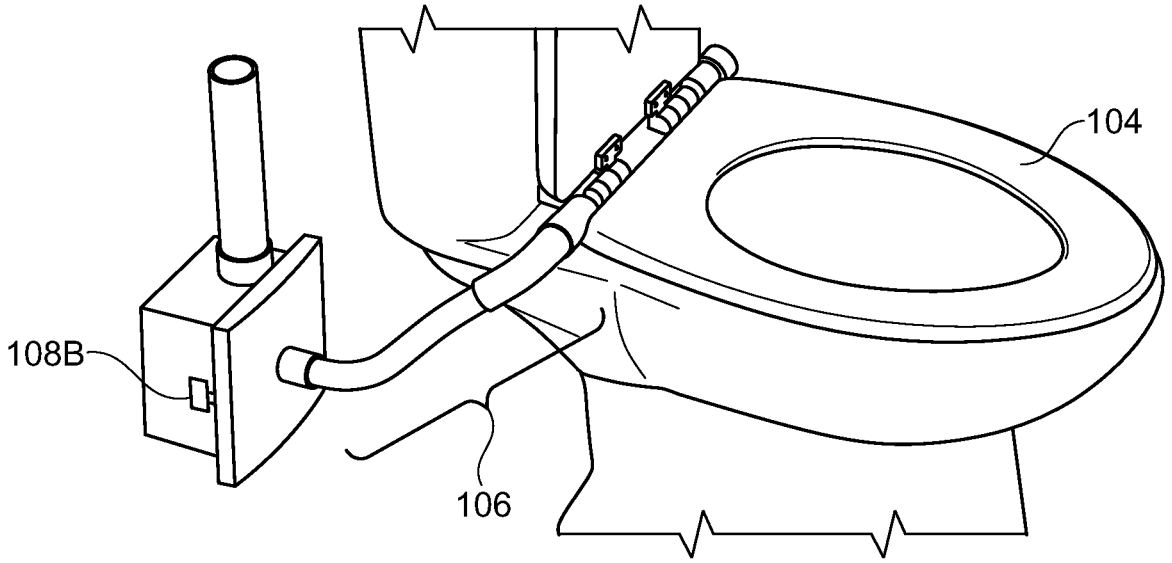
Figure 5C:
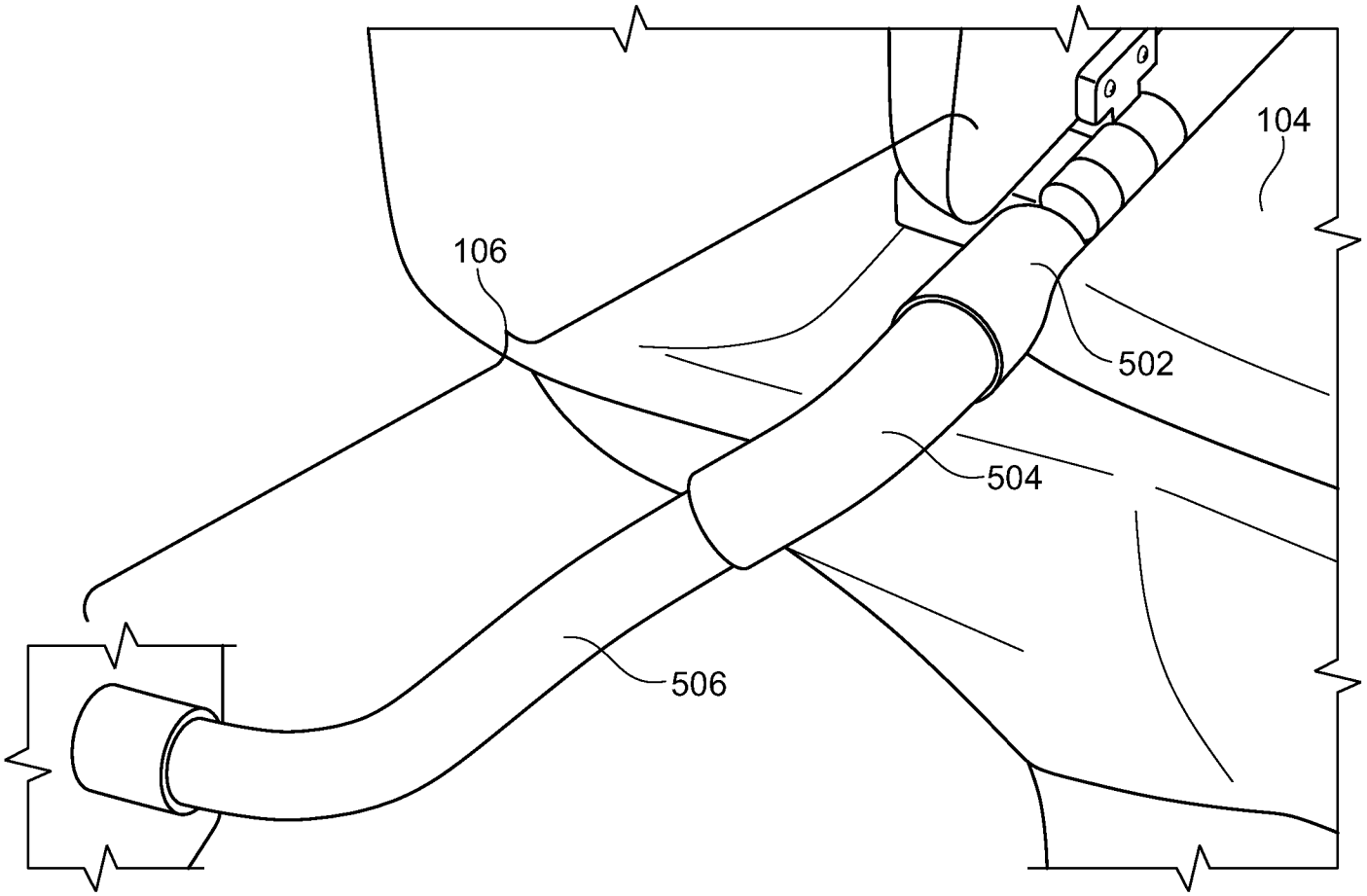

FIGS. 5A and 5B show examples of a vent coupler 106 coupled between the ventilated seat assembly 104 and the retrofit and built in versions of the powered exhaust system 108A, 108B. As shown in FIG. 5C, the vent coupler 106 includes a vent tail 502, a vent pipe elbow 504, and a vent pipe 506. In some embodiments, the vent pipe 506 may be implemented as one piece, including the vent pipe elbow 504. The vent tail 502 may be molded as part of, attached to, or otherwise be integral with the seat 204, and may extend laterally from the rear portion 220 of the seat 204, and may provide an air flow path from the vent cavity 206 to the vent pipe elbow 504. Referring to FIG. 4, the vent coupler portion 210 may at least include the vent tail 502 and vent tail elbow 504. Returning to FIG. 5A, the vent tail 502 be attached to either side of the ventilated seat assembly 104, and for ventilated seat assemblies with two ventails 502, one on each side, one vent tail may optionally include a cap 508. As shown in FIG. 5C, the vent tail 502 may be coupled to, or integral with, the seat 204, and may be configured to rotate with the seat as the seat rotates open and closed, creating a stationary axis of rotation. The vent pipe elbow 504 may be rotatably coupled to the vent tail 502 with a seal, such that as the vent tail 502 rotates with the seat as the seat rotates open and closed, the vent pipe elbow 504 remains stationary. The vent tail 502 may be coupled to the vent pipe elbow 504 using a threaded coupling, a bayonet coupling, a compression fitting, or any other suitable connection that maintains an air flow through the vent tail 502 and vent pipe elbow 504.

As shown in FIG. 1, both the retrofit and built in aspects of the disclosed embodiments may include an electronic control unit 110 coupled to the powered exhaust system 108A, 108B.

Figure 6A:
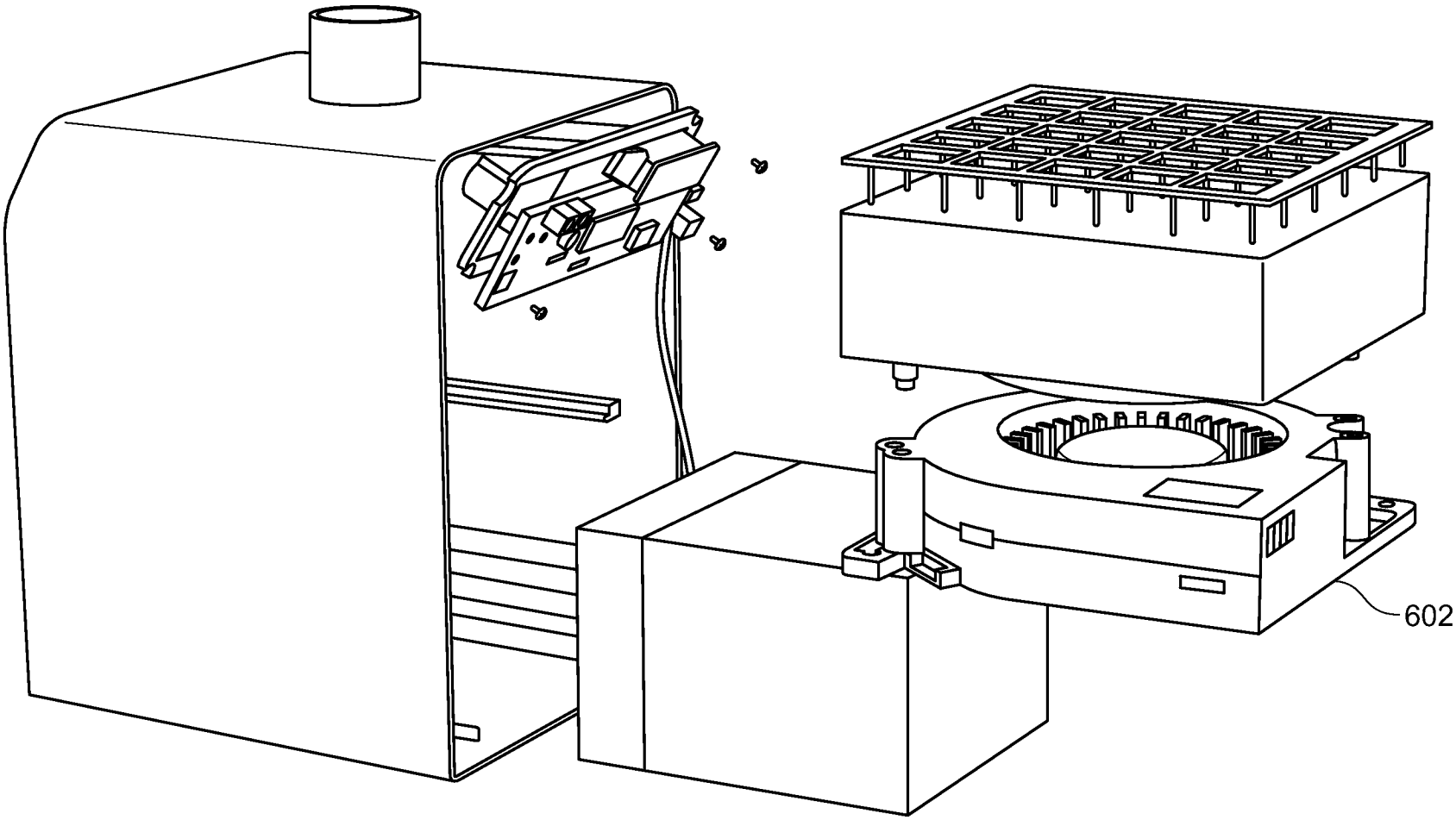
FIGS. 6A and 6B illustrate that a powered exhaust system for both retrofit and built in aspects of the disclosed embodiments include a fan.
Figure 6B:
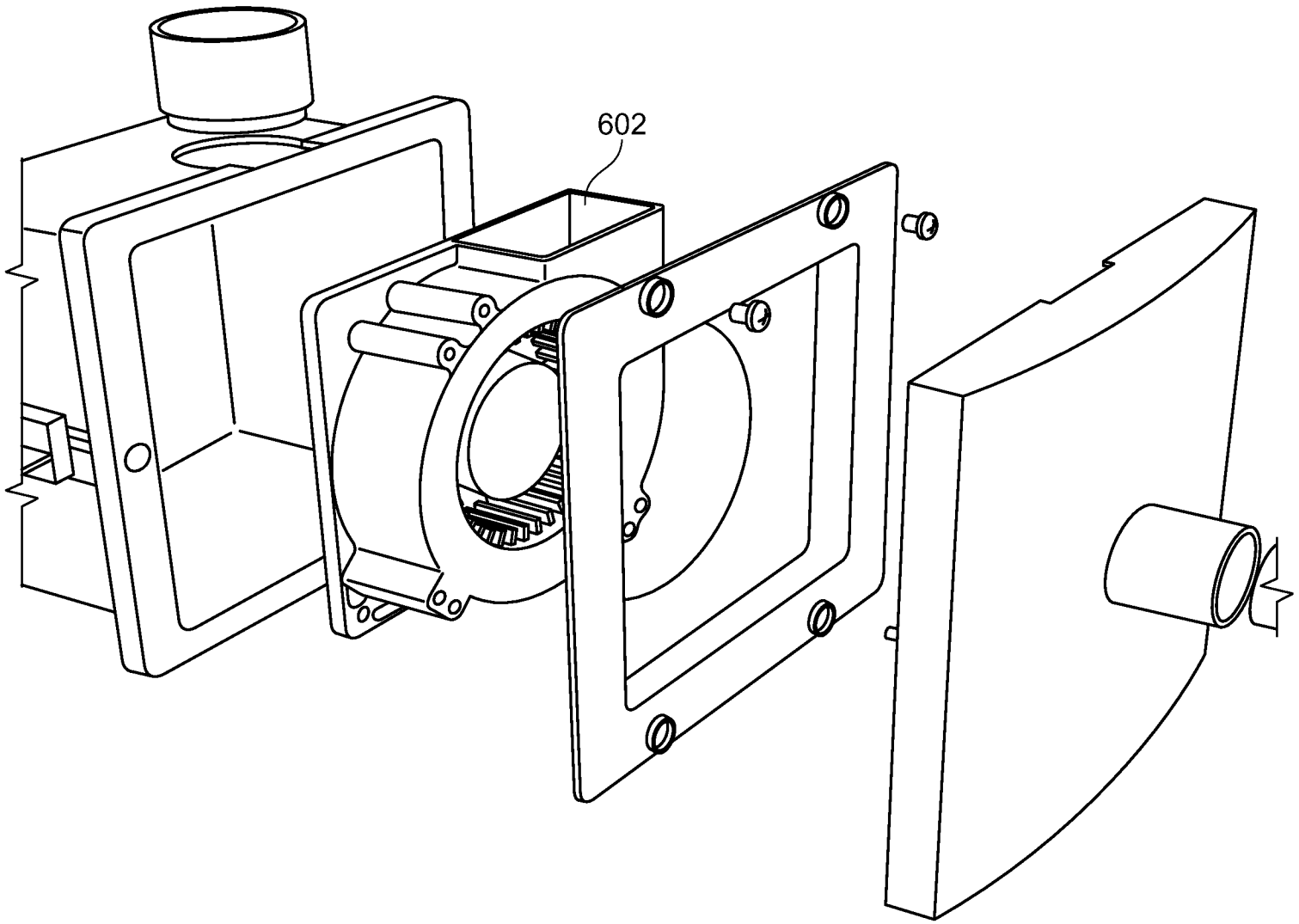

Furthermore, as shown in FIGS. 6A and 6B, the powered exhaust system 108A, 108B for both the retrofit 102A and built in 102B aspects of the disclosed embodiments may include a fan 602 for drawing air from the vent couplers 106.

Figure 7:
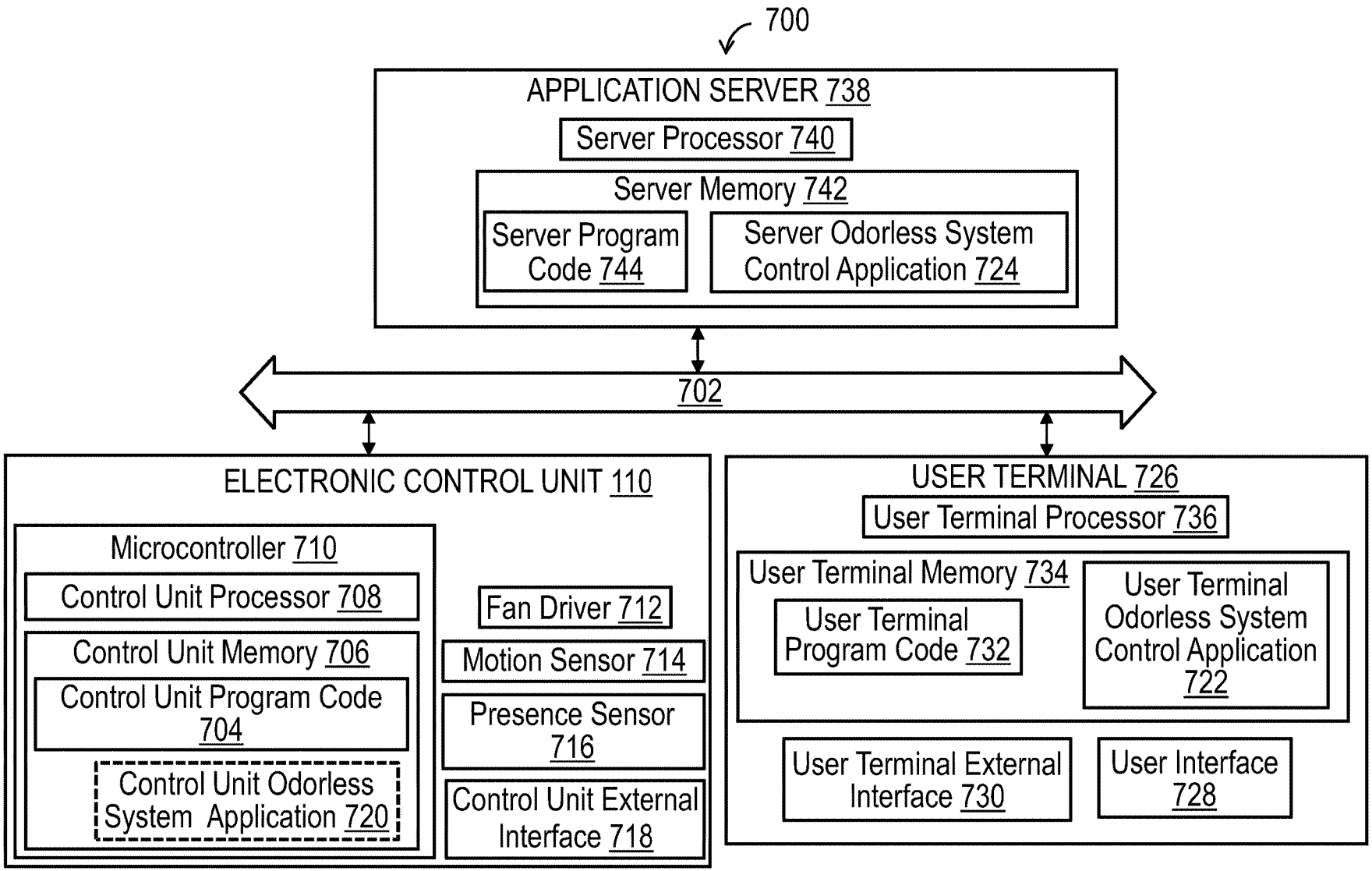
FIG. 7 shows a block diagram of an electronic control unit.

FIG. 7 shows a block diagram of the electronic control unit 110. In some embodiments, the control unit 110 may be a component of a system 700 configured to operate the control unit 110 wirelessly over a local or wireless network 702. The electronic control unit 110 may include computer readable control unit program code 704 stored on at least one non-transitory computer readable medium for carrying out and executing the operational modes described herein. The computer readable medium may be a control unit memory 706 which may include magnetic media, semiconductor media, optical media, or any media which is readable and executable by a computing device. The electronic control unit 110 may also include a control unit processor 708 for executing the computer readable control unit program code 704, and the control unit program code 704, control unit memory 706, and control unit processor 708 may be components of a microcontroller 710. The electronic control unit 110 may also include at least a fan driver 712 for powering the fan 602 and a motion sensor 714, or a connection to the motion sensor 714. While the motion sensor 714 may be described as part of the electronic control unit 110, it should be understood that the motion sensor 714 may be located remote from the electronic control unit 110, for example, as part of the ventilated seat assembly 104, on an adjacent wall, or any other suitable location.

The microcontroller 710 may be an 8 bit, 20 Mhz microcontroller with 32 KB of memory. The fan driver 712 may be a 100V n-channel power MOSFET, and the motion sensor 714 may be a distance measuring sensor unit with an integrated combination of a position sensitive detector, an infrared diode, and signal processing circuitry.

The microcontroller 710 under control of the computer readable control unit program code 704 may be configured to implement a first operational mode, which may include upon detecting a first motion, for example, a hand wave or any other suitable motion by a user, by the motion sensor 714, using the fan driver 712 to apply power to the fan 602, and then upon detecting a second motion, for example, another hand wave or other suitable motion, by the motion sensor 714, using the fan driver to disconnect power to the fan 602.

The electronic control unit 110 may also include a presence sensor 716, or a connection to the presence sensor 716, which may be a pyroelectric infrared sensor constructed of a piezoelectric ceramic material, and the microcontroller 710 under control of the computer readable control unit program code 704 may be configured to implement a second operational mode where, upon detecting a third motion, including a hand wave or other suitable motion by the motion sensor 714, using the fan driver 712 to apply power to the fan 602, and upon no longer detecting a presence by the presence sensor 716, using the fan driver 712 to disconnect power to the fan 602 after a programmable delay. While the presence sensor 716 may be described as part of the electronic control unit 110, it should be understood that the presence sensor 716 may be located remote from the electronic control unit 110, for example, as part of the ventilated seat assembly 104, on an adjacent wall, or any other suitable location.

The microcontroller 710 under control of the computer readable control unit program code 704 may also be configured to implement a third operational mode where, upon detecting a presence by the presence sensor 716, using the fan driver 712 to apply power to the fan 602, and upon no longer detecting a presence by the presence sensor 716, using the fan driver 712 to disconnect power to the fan 602 after a programmable delay.

The electronic control unit 110 may also include a control unit external interface 718 for controlling external devices under control of the microcontroller 710, for example, automatic flush control systems. In some embodiments, the control unit external interface 718 may include a network interface for communicating over the network 702 using a control unit odorless system application 720 stored as programming code in the control unit memory 706. The control unit odorless system application 720 may communicate with a user terminal odorless system control application 722 or a server odorless system control application 724, operating to control the operation of the odorless system 100 remotely from a user terminal.

As shown in FIG. 7, a user terminal 726 may operate the user terminal odorless system control application 722 to directly communicate with the electronic control unit 110 over the network 702 to control the odor removing system 100. The user terminal 726 may include a user interface 728 that may further include at least a display and one or more input and output devices, for example, a virtual reality or augmented reality device, a keyboard, a mouse, a touch screen, and a voice control module. The user terminal 726 may also include a user terminal external interface 730 that includes a network interface for communicating over the network 702. The user terminal 726 may be implemented as, for example, a desktop computer, laptop, tablet, mobile phone, or any other computing device capable of performing the functions of the disclosed embodiments. It should be understood that a user may utilize more than one and different types of the user terminals 726 to operate the user terminal odorless system control application 722. For example, a user may use a mobile phone as a user terminal at one point in time and later may use a tablet as a user terminal.

The user terminal 726 may include computer readable user terminal program code 732 stored on at least one non-transitory computer readable medium for carrying out and executing the processes described herein. In at least one embodiment, the computer readable user terminal program code 732 may invoke or operate the user terminal odorless system control application 722. The computer readable medium may include a user terminal memory 734, and in alternate aspects, the computer readable user terminal program code 732 may be stored in one or more memories external to, or remote from the user terminal 726. The user terminal memory 734 may include magnetic media, semiconductor media, optical media, or any media which is readable and executable by a computer. The user terminal 726 may also include a user terminal processor 736 for executing the computer readable program code 732. The user terminal odorless system control application 722 may allow a user of the user terminal to monitor the operation and status of the odor removing system 100, select an operational mode, described below, set a fan speed, turn the 602 fan on and off, enable and disable the motion 714 and presence 716 sensors, monitor battery status where applicable, and perform any other function of the odor removing system 100, remotely from the user terminal 726.

In some embodiments, the user terminal odorless system control application 722 may allow a user of the user terminal to indirectly communicate with the electronic control unit 110 over the network 702 by providing an interface to the server odorless system control application 724 to control the odor removing system 100. In those embodiments, the user terminal odorless system control application 722 may operate as an interface to the server odorless system control application 724, and the server odorless system control application 724 may include the functionality that allows the user of the user terminal 726 to monitor the operation and status of the odor removing system 100, select an operational mode, described below, set a fan speed, turn the 602 fan on and off, enable and disable the motion 714 and presence 716 sensors, and perform any other function of the odor removing system 100, remotely from the user terminal 726. The server odorless system control application 724 may be stored on or be accessed by an application server 738 which may include a server processor 740 and server memory 742 storing computer server program code 744 for generally operating the application server 738 to provide the system and method described herein. In some embodiments, the application server 738 may be implemented by a cloud computing service, and the system and method may be provided in the form of software as a service (SaaS).

Figure 8A:
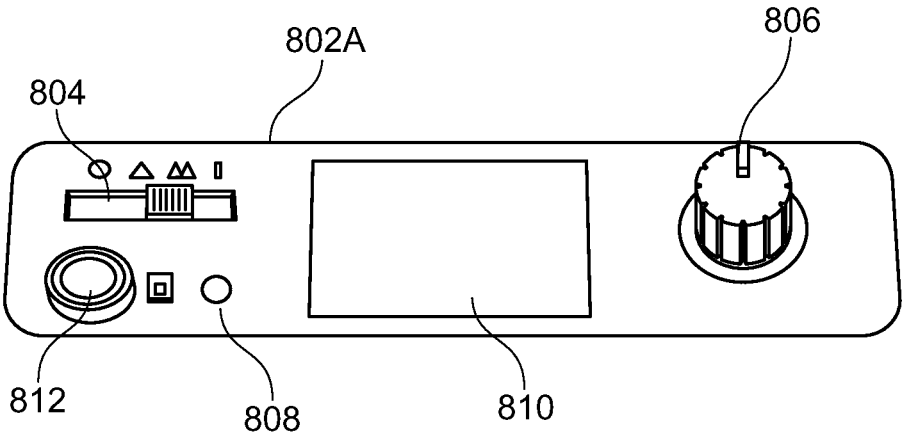
FIGS. 8A and 8B depict front panels of the electronic control unit.
Figure 8B:
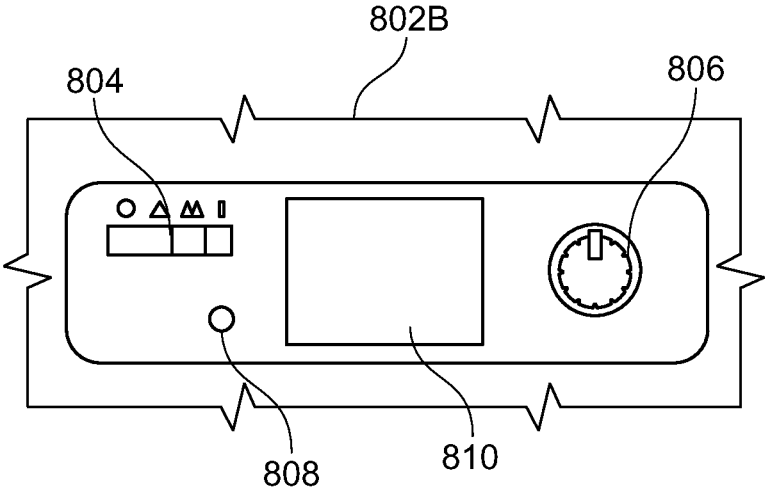

FIGS. 8A and 8B depict front panels 802A, 802B, of the electronic control unit 110 for the retrofit 102A and built in 102B embodiments, respectively. Both front panels 802A, 802B may include a mode switch 804, a manual fan speed control 806, a status indicator 808, and a window for the motion sensor 714 and the presence sensor 716. The microcontroller 710 may determine which of the operational modes of the system based on positions of the mode switch 804. The microcontroller 710 may adjust power to the fan 602 based on positions of the manual fan speed control 806. The status indicator 808 may emit a color, for example green, to indicate that the electronic control unit is operational. On the front panel 802A for the retrofit embodiment 102A, the status indicator 808 may emit another color, for example red, to indicate that a battery needs charging.

The front panel 802A of the electronic control unit 110 for the retrofit embodiment may also include a battery charging port 812 for providing power to a battery used to power the retrofit embodiment 102A.

It should be noted that the powered exhaust system 108A for the retrofit embodiment 102A includes a battery for powering the electronic control unit 110, while the powered exhaust system 108B for the built in embodiment 102B includes a connection to a mains power supply for powering the electronic control unit 110.

Figure 9A:
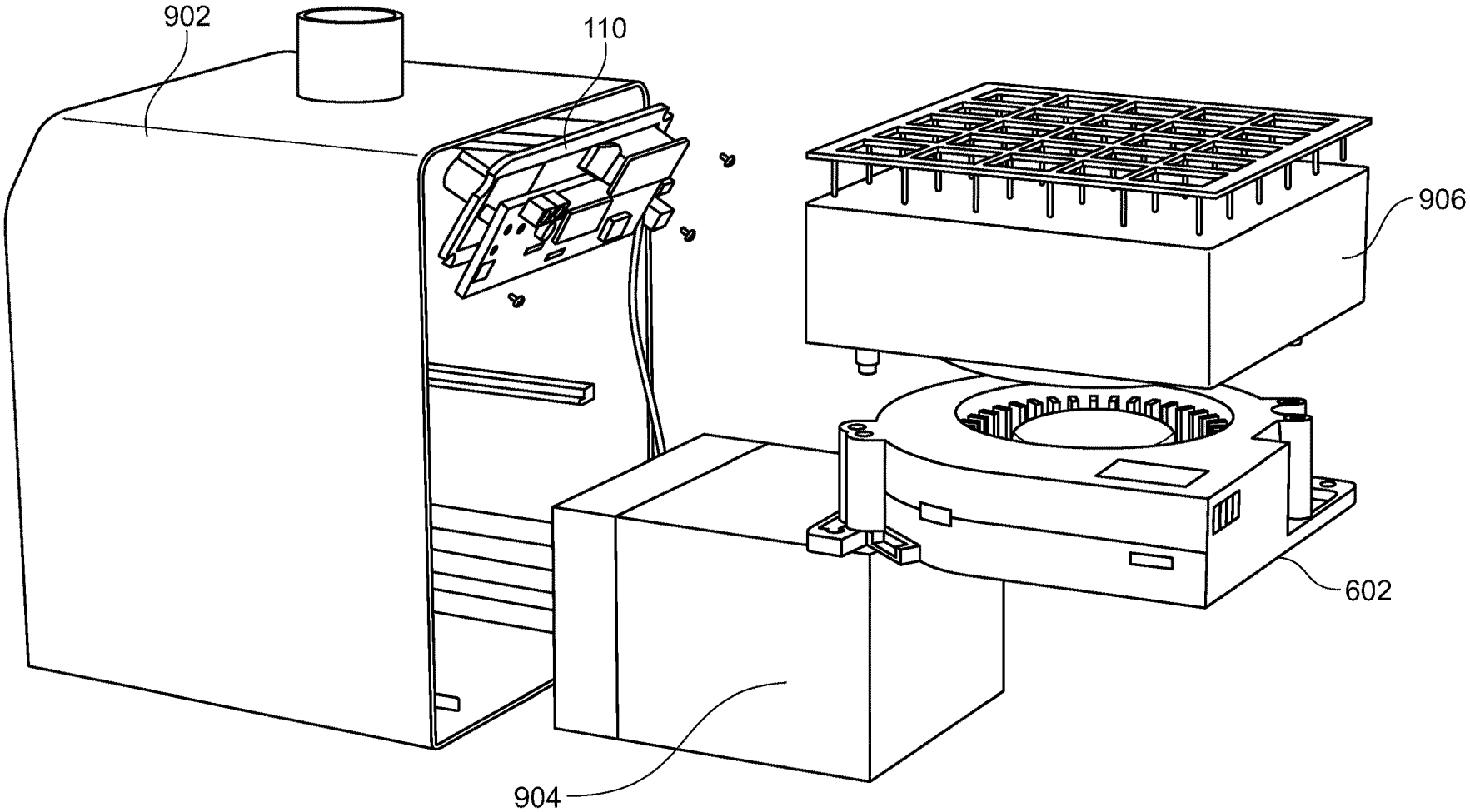
FIGS. 9A and 9B illustrate depict components of the retrofit powered exhaust system and the built in powered exhaust system.
Figure 9B:
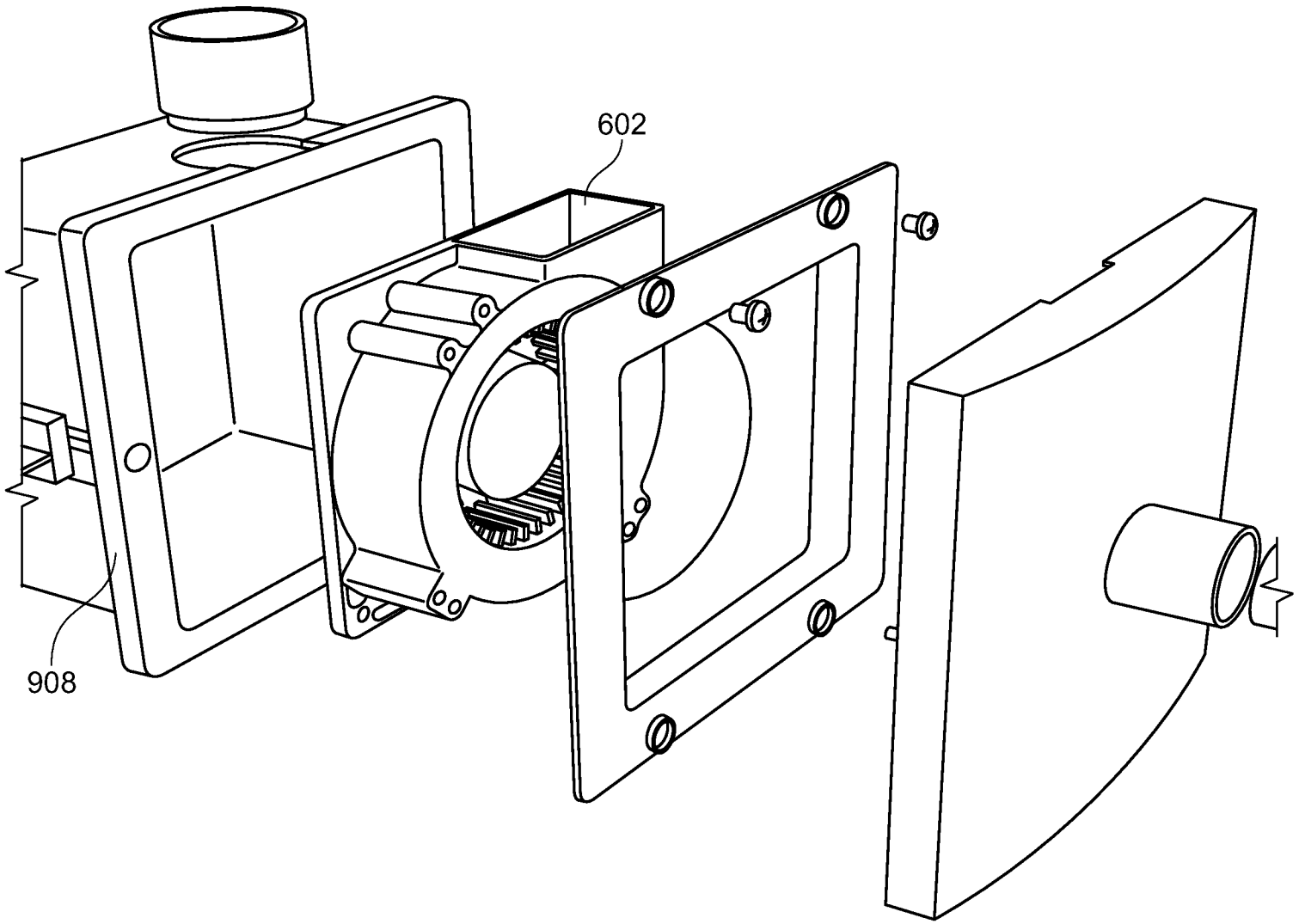

FIGS. 9A and 9B illustrate depict components of the retrofit powered exhaust system 108A and the built in powered exhaust system 108B as previously shown in FIGS. 6A and 6B. The retrofit powered exhaust system 108A may include a free standing enclosure 902 into which the fan 602, a battery 904 for powering the retrofit powered exhaust system 108A, the electronic control unit 110, and a filter 906 are assembled. The filter 906 may be rectangular and positioned to be easily replaceable. For example, the enclosure 902 and filter 906 may be configured such that the filter 906 may slide out for replacement, similar to conventional heating, ventilation and air conditioning systems. The filter 906 may be composed of activated carbon. Carbon filtration is a time-tested, highly effective method of capturing volatile organic compounds, the primary component of odorous toilet gases, from air and water.

The built in powered exhaust system 108B may include a built in enclosure 908, typically installed in a wall, into which the fan 602 is assembled. The control panel 802B for the built in powered exhaust system 108B may be located remotely from the built in enclosure 908.

The disclosed embodiments advantageously provide a system for removing bathroom odors from a toilet without any modification to existing or new bathroom toilet fixtures.

It is noted that the embodiments described herein can be used individually or in any combination thereof. It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

Various modifications and adaptations may become apparent to those skilled in the relevant arts in view of the foregoing description, when read in conjunction with the accompanying drawings. However, all such and similar modifications of the teachings of the disclosed embodiments will still fall within the scope of the disclosed embodiments.

Various features of the different embodiments described herein are interchangeable, one with the other. The various described features, as well as any known equivalents can be mixed and matched to construct additional embodiments and techniques in accordance with the principles of this disclosure.

Furthermore, some of the features of the exemplary embodiments could be used to advantage without the corresponding use of other features. As such, the foregoing description should be considered as merely illustrative of the principles of the disclosed embodiments and not in limitation thereof.

DESIGNATIONS

100 odor removing system
102A retrofit embodiment
102B built in embodiment
104 ventilated seat assembly
106 vent couplers
108A retrofit powered exhaust system
108B built in powered exhaust system
110 electronic control unit
200 exploded diagram of seat assembly
202 assembled diagram of seat assembly
204 seat
206 vent cavity
208 vent cover plate
210 portions of vent couplers 106
212 bowl ridge seal
214 seat top side
216 seat bottom side
218 seat front portion
220 seat rear portion
222 vent cavity inlet opening
224 vent cavity outlet
226 vent cover plate openings
302, 304 vent cover plate tabs
306, 308 seat slots
402 hinges
502 vent tail
504 vent pipe elbow
506 vent pipe
508 vent tail cap
602 fan
702 network
704 control unit program code
706 control unit memory
708 control unit processor
710 microcontroller
712 fan driver
714 motion sensor
716 presence sensor
718 control unit external interface
720 control unit odorless system application
722 user terminal odorless system control application
724 server odorless system control application

726 user terminal
728 user interface
730 user terminal external interface
732 user terminal program code
734 user terminal memory
736 user terminal processor
738 application server
740 server processor
742 server memory
744 server program code
802A retrofit front panel
802B built in front panel
804 mode switch
806 manual fan speed control
808 status indicator
810 sensor window
812 charging port

The invention claimed is:

1. A system for removing odors from a toilet comprising:
a ventilated seat assembly having:
a seat having a top side, a bottom side, front portion and a rear portion;
a vent cavity within the seat and having an inlet opening on the bottom side of the seat and at least one outlet to the one or more vent couplers;
a vent cover plate covering the opening of the vent cavity; and
a bowl ridge seal extending from a bottom side of the seat assembly, wherein the bowl ridge seal extends from a bottom surface of the vent cover plate along a perimeter of the vent cover plate, and flexibly contacts a top or side edge of a toilet bowl on which the ventilated seat assembly is installed to provide at least a partial seal for guiding air into the vent cover plate;
a powered exhaust system; and
one or more vent couplers coupled between the ventilated seat assembly and the powered exhaust system, wherein the powered exhaust system is configured to draw air from the ventilated seat assembly through the one or more vent couplers.

2. The system of claim 1, wherein the vent cover plate comprises openings through which air may be drawn into the vent cavity.

3. The system of claim 1, wherein the bowl ridge seal extends from the bottom side of the seat along a perimeter of the seat, and flexibly contacts a top or side edge of a toilet bowl on which the ventilated seat assembly is installed to provide at least a partial seal for guiding air into the vent cover plate.

4. The system of claim 1, wherein at least one of the one or more vent couplers comprises a cap.

5. The system of claim 1, wherein at least one of the one or more vent couplers comprises:
a vent tail extending laterally from the rear portion of the seat; and
a vent pipe coupled to the vent tail and to the powered exhaust system, wherein the laterally extending vent tail is configured to rotate with the seat as the seat rotates open and closed, while the vent pipe remains stationary.

6. The system of claim 1, wherein the powered exhaust system comprises:
an electronic control unit; and
a fan for drawing air from the vent couplers.

7. The system of claim 6, wherein the electronic control unit comprises:
a motion sensor; and
a microcontroller having a memory with computer readable program code, the microcontroller under control of the computer readable program code configured to implement:
a first operational mode, wherein, upon detecting a first motion by the motion sensor, applying power to the fan, and upon detecting a second motion by the motion sensor, disconnecting power to the fan.

8. The system of claim 7, wherein the electronic control unit further comprises a presence sensor, and wherein the microcontroller under control of the computer readable program code configured to implement:
a second operational mode comprising, upon detecting a third motion by the motion sensor, applying power to the fan, and upon no longer detecting a presence by the presence sensor, disconnecting power to the fan after a programmable delay; and
a third operational mode comprising, upon detecting a presence by the presence sensor, applying power to the fan, and upon no longer detecting a presence by the presence sensor, disconnecting power to the fan after a programmable delay.

9. The system of claim 8, comprising a mode switch, wherein the microcontroller determines the operational modes of the system based on positions of the mode switch.

10. The system of claim 7, comprising a manual fan speed control; wherein the microcontroller adjusts power to the fan based on positions of the manual fan speed control.

11. The system of claim 7, wherein the powered exhaust system comprises a connection to a mains power supply for powering the electronic control unit.

12. The system of claim 7, wherein the powered exhaust system comprises a battery for powering the electronic control unit.

13. The system of claim 12, further comprising a filter coupled to the fan for filtering odors from the air flowing from the vent couplers.

* * * * *